US005378050A

United States Patent [19]

Kammerer et al.

[11] Patent Number: 5,378,050

[45] Date of Patent: Jan. 3, 1995

[54] CYLINDER-SHAPED CUTTING BODY FOR A COAL CUTTING MACHINE

[75] Inventors: Karl Kammerer, Fluorn-Winzeln, Germany; Bernhard Diessner, Fulpmes, Austria

[73] Assignee: BETEK Bergbau- und Hartmetalltechnik Karl-Heinz, Germany

[21] Appl. No.: 115,156

[22] Filed: Aug. 31, 1993

[30] Foreign Application Priority Data

Sep. 1, 1992 [DE] Germany ..... 9211739[U]

[51] Int. Cl.[6] ..... E21C 35/18

[52] U.S. Cl. ..... 299/91; 299/93

[58] Field of Search ..... 299/91, 93, 86

[56] References Cited

U.S. PATENT DOCUMENTS 2,296,235 9/1942 Fulke ..... 299/93
4,693,518 9/1987 Sulosky et al. ..... 299/93
5,011,229 4/1991 O'Neil et al. ..... 299/93 X

FOREIGN PATENT DOCUMENTS 3611446 2/1988 Germany .
1486549 9/1977 United Kingdom ..... 299/93

*Primary Examiner*—David J. Bagnell
*Attorney, Agent, or Firm*—Speckman, Pauley & Fejer

[57] ABSTRACT

A cylinder-shaped cutting body for a coal cutting machine with a clearing and loading worm or clearing screw comprising basic parts disposed at even spacings and placed on the cutting body surface so that it projects away from the cutting body surface whereby a chisel holder interchangeably receiving a chisel can be connected to each basic part. The chisel holder has a plug-in neck which, in the direction of a chisel receptacle, has a shoulder for limiting the insertion movement of the plug-in neck into a plug-in receptacle of the basic part. Looking in the direction of running of the cutting body, behind the chisel receptacle of the chisel holder, a pressure screw, accessible from the top of the basic part, is disposed in the basic part and is adjustable with respect to the plug-in neck of the chisel holder so that it exerts a retracting force on the plug-in neck of the chisel holder.

14 Claims, 1 Drawing Sheet

CYLINDER-SHAPED CUTTING BODY FOR A COAL CUTTING MACHINE

BACKGROUND OF THE INVENTION

1. Field of the Invention

This invention relates to a cylinder-shaped cutting body for a coal cutting machine with a clearing and loading worm or clearing screw composed of basic parts disposed at even spacings and placed on the cutting body surface so that it projects away from the cutting body surface, wherein a chisel holder interchangeably receiving a chisel can be connected to each basic part.

2. Description of Prior Art

A cylinder-shaped cutting body of this type is taught by German Patent Publication DE 36 11 446 C2. The basic parts support a dovetail-shaped fastening bar which conically widens in the direction opposite the running direction of the cutting body. The chisel holder has a corresponding dovetailed groove on its underside. The chisel holder is pushed onto the fastening bar in the direction opposite the running direction of the cutting body and is clamped. This clamping is further reinforced when the chisel is put under load in the chisel holder. To remove the chisel from the fastening bar of the basic part, a substantial force must be applied to the side of the chisel holder opposite the running direction of the cutting body to loosen the clamping between the fastening bar of the basic part and the dovetailed groove of the chisel holder. If the chisel holders are disposed on the clearing and loading worm or clearing screw at small distances from each other, removal of the chisel holders from the basic parts is very difficult because access to these sides of the chisel holders with a tool is difficult.

Cylinder-shaped cutting bodies of the above-mentioned type are also available in the trade wherein the chisel holders are fastened on the basic part by screws or wedges. In this case, the screws or wedges are disposed in the basic part and are accessible from the sides constituting the clearing and loading worm or clearing screw. This manner of fastening the chisel holders to the basic part also makes the installation and removal of the chisel holders difficult, particularly if the pitch of the clearing and loading worm or clearing screw is small or if the clearing and loading worm or clearing screw terminates at the ends of the cylinder-shaped cutting body.

SUMMARY OF THE INVENTION

It is an object of this invention to provide a cylinder-shaped cutting body of the previously mentioned type wherein the installation and removal of the chisel holders from the basic parts is considerably eased, even with terminating clearing and loading worms or clearing screws and with a small pitch of the same.

This object is attained in accordance with one embodiment of this invention where the chisel holder forms a chisel receptacle and comprises a plug-in neck which, in the direction of the chisel receptacle, has a shoulder for limiting the insertion movement of the chisel holder into a corresponding plug-in receptacle formed by the basic part. In the direction of running of the cutting body, behind the chisel receptacle of the chisel holder, a pressure screw, accessible from the top of the basic part, is disposed in the basic part. The pressure screw is adjustable with respect to the plug-in neck of the chisel holder so that it exerts a retracting force on the plug-in neck of the chisel holder.

Accordingly, the basic part can be welded to or screwed to the surface of the cutting body. The chisel holder is simply plugged into the plug-in receptacle of the basic part and is retracted under pressure by the pressure screw.

In this case, the pressure screw behind the chisel does not adversely affect the cutting operation and it is always easily accessible from the top of the clearing and loading worm or clearing screw. An obviously firm seating of the chisel holder on the basic part is achieved by the pressure screw.

In accordance with one embodiment of this invention, the plug-in neck of the chisel holder and the plug-in receptacle of the basic part have non-rounded cross sections, so that the plug-in neck is held fixed against relative rotation in the plug-in receptacle. As a result, an automatic alignment between the basic part and the chisel holder with the installed chisel can be achieved.

To obtain a good cutting operation, in accordance with another embodiment of this invention, the chisel receptacle of the chisel holder is offset with respect to the plug-in neck in a direction opposite to the running direction of the cutting body. The axis of the chisel receptacle is inclined in the direction of the cutting body and forms an acute angle with the diameter of the cutting body at the tip of the chisel.

In accordance with yet another embodiment of this invention, the shoulder of the chisel holder is supported on the basic part behind and on the side of the plug-in neck, at least in the running direction of the cutting body. Behind the chisel receptacle of the chisel holder, the top surface of the basic part is recessed in the direction of the cutting body surface. As a result, the basic part does not hinder the insertion of the chisel into the chisel receptacle.

Protection against twisting while maintaining sufficient clamping of the plug-in neck of the chisel holder is achieved where the cross sections of the plug-in neck and the plug-in receptacle are embodied as square or rectangular with rounded-off or slanted corners. One side of the plug-in neck faces the pressure screw and the front face of the pressure screw is supported on a pressure surface of a recess in this side of the plug-in neck. In accordance with a preferred embodiment of this invention, the longitudinal axis of the pressure screw is aligned at an angle of less than 90° with respect to the longitudinal axis of the plug-in neck of the chisel holder.

Additional support when removing the chisel holder is achieved where the base part has a lateral recess on the underside facing the cutting body surface which extends as far as the plug-in receptacle for the plug-in neck of the chisel holder.

To increase the service life, in accordance with one embodiment of this invention, the basic part and the chisel holder are forged, hardened and tempered.

BRIEF DESCRIPTION OF THE DRAWINGS

The objects and features of this invention will be better understood from the following detailed description taken in conjunction with the drawings wherein.

DESCRIPTION PREFERRED EMBODIMENTS

Figure 1:
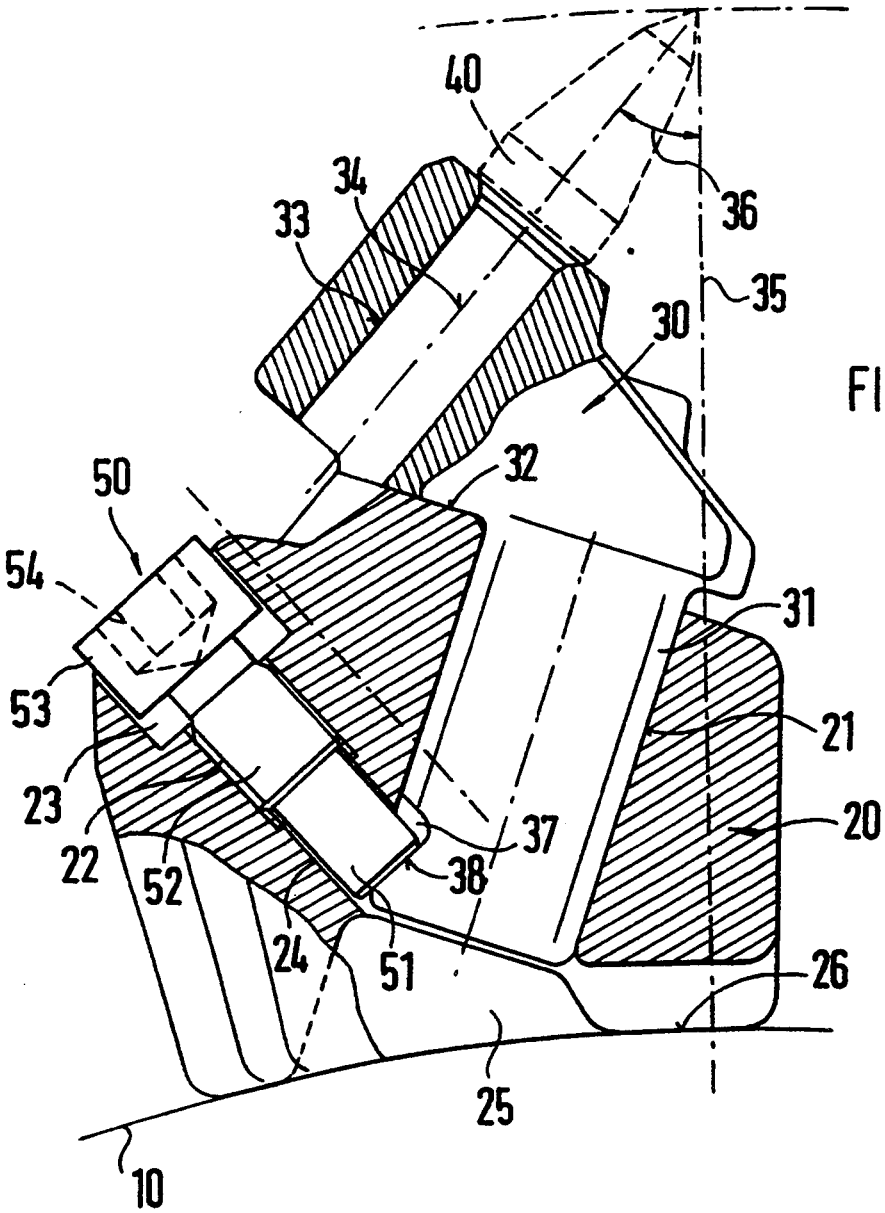
FIG. 1 is a cross-sectional side view of a device in accordance with one embodiment of this invention.
Figure 2:
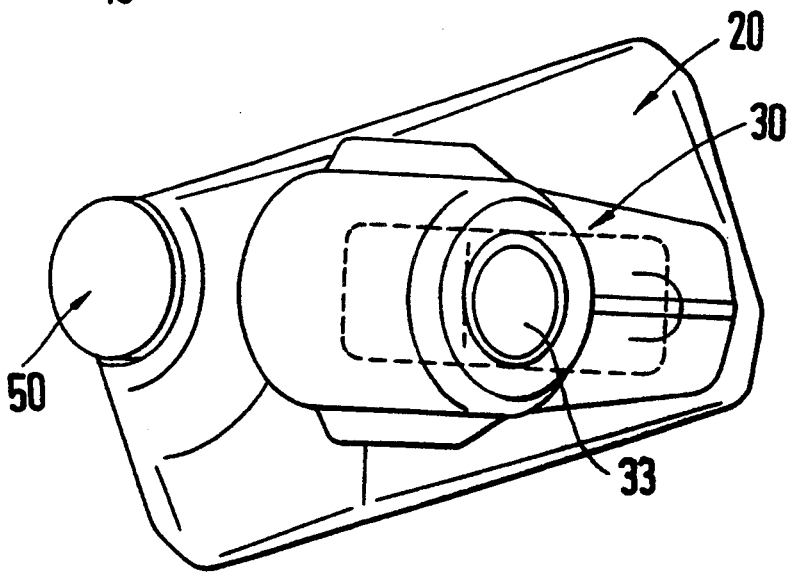
FIG. 2 is a top view of the device shown in FIG. 1.

FIG. 1 shows the cutting body surface 10 of a cylinder-shaped cutting body. Cuboid basic parts 20 are fastened on this cutting body surface 10 in a row, forming a clearing and loading worm or clearing screw with the walls of their broad sides. The basic part 20 can be welded to or screwed onto the cutting body surface 10. To obtain a long service life, the basic part 20 is forged, hardened and tempered.

The underside of the basic part 20 forming a middle hollow portion 25 and a front support portion 26 on the lower side of the basic part 20 directed to the cutting body surface 10 is concave and is adapted to the curvature of the cutting body surface 10. A plug-in receptacle 21 is formed by the basic part 20, into which a plug-in neck 31 of a chisel holder 30 is inserted. The plug-in receptacle 21 and the plug-in neck 31 have a non-round, preferably square or rectangularly shaped cross section, so that the plug-in neck 31 can only be inserted into the plug-in receptacle 21 in the correct position and is held therein secure against twisting. The portion of the chisel holder 30 beyond the plug-in neck 31 and extending from the plug-in receptacle 21 forms a chisel receptacle 33 for receiving a chisel 40 of a known type in an interchangeable manner. The chisel receptacle 33 is offset with respect to the plug-in neck 31 in a direction opposite to the direction of running of the cutting body. The central axis 34 of the chisel receptacle 33 and of the chisel 40 form an acute angle 36 of, for example, 40°, together with the diameter 35 of the cutting body extending through the tip of the chisel 40. Beyond the plug-in neck 31, the chisel holder 30 forms a shoulder 32 limiting the insertion movement of the chisel holder 30.

One side of the plug-in neck 31 faces a pressure screw 50 which is adjustably disposed in the base part 20 behind the chisel receptacle 33, that is, beyond the chisel 40. This pressure screw 50 terminates in a pressure section 51 which is supported on a pressure surface 38 of a recess 37 in the facing side of the plug-in neck 31 such that a retracting force is exerted on the chisel holder 30 which clamps and fixes the plug-in neck 31 and, thus, the chisel holder 30 against the basic part 20. In accordance with this embodiment, a threaded section 52 of the pressure screw 50 is adjustable in an interior thread 22 of the base part 20. The pressure section 51 of the pressure screw 50 is guided in the end section 24 of the screw receptacle. The pressure screw 50 has a head 53, which is countersunk in a widening 23 of the screw receptacle. The head 53 of the pressure screw 50 has a hexagonal socket 54 for receiving a tool. In this way, the pressure screw 50 is protectively housed in the base part 20. Where the center axes of the pressure screw 50 and of the plug-in neck 31 enclose an angle of less than 90°, a force component, which retracts the plug-in neck 31 into the plug-in receptacle 21, is transferred to the pressure surface 38 of the recess 37 through the front face of the pressure section 51 of the pressure screw 50.

What is claimed is:

1. In a cylinder-shaped cutting body for a coal cutting machine having one of a clearing and loading worm and a clearing screw comprising basic parts disposed at even spacings and placed on the cutting body surface so that it projects away from said cutting body surface, whereby a chisel holder interchangeably receiving a chisel can be connected to each basic part, the improvement comprising:

said chisel holder (30) forming a chisel receptacle and comprising a plug-in neck (31) which, in the direction of said chisel receptacle (33), transforms into a shoulder (32), said shoulder (32) limiting an insertion movement of said plug-in neck (31) into a plug-in receptacle (21) of the basic part (20), looking in the direction of running of the cutting body, behind the chisel receptacle (33) of the chisel holder (30), a pressure screw (50), accessible from the top of the basic part (20), disposed in the basic part (20) and adjustable with respect to the plug-in neck (31) of the chisel holder (30), said pressure screw (50) exerting a retracting force on the plug-in neck (31) of the chisel holder (30), and said shoulder (32) of the chisel holder (30) supported on the basic part (20) at least behind and on a side of the plug-in neck in the running direction of the cutting body.

2. In a cylinder-shaped cutting body in accordance with claim 1, wherein said plug-in receptacle (21) of the basic part (20) has a non-rounded cross section, whereby said plug-in neck (31) is held fixed against relative rotation in said plug-in receptacle (21).

3. In a cylinder-shaped cutting body in accordance with claim 2, wherein said chisel receptacle (33) of the chisel holder (30) is offset with respect to the plug-in neck (31) in a direction opposite to the running direction of the cutting body, and an axis (34) of the chisel receptacle (33) is inclined in a direction of the cutting body and forms an acute angle (36) with a diameter (35) of the cutting body at a tip of the chisel (40).

4. In a cylinder-shaped cutting body in accordance with claim 3, wherein said shoulder (32) of the chisel holder (30) is supported on the basic part (20) behind and on a side of the plug-in neck (31), at least in the running direction of the cutting body, and behind the chisel receptacle (33) of the chisel holder (30), a top surface of the basic part (20) is recessed in the direction toward the cutting body surface (10).

5. In a cylinder-shaped cutting body in accordance with claim 4, wherein a cross section of the plug-in neck (31) and the plug-in receptacle (21) are rectangular with one of rounded-off and slanted corners, one side of the plug-in neck (31) faces the pressure screw (50), and a front face of the pressure screw (50) is supported on a pressure surface (38) of a recess (37) in said side of the plug-in neck (31).

6. In a cylinder-shaped cutting body in accordance with claim 5, wherein a longitudinal axis of the pressure screw (50) is aligned at an angle of less than 90° with respect to a longitudinal axis of the plug-in neck (31) of the chisel holder (30).

7. In a cylinder-shaped cutting body in accordance with claim 6, wherein the basic part (20) has a lateral recess (25) on an underside facing the cutting body surface (10), said lateral recess (25) extending as far as the plug-in receptacle 21 for the plug-in neck (31) of the chisel holder (30).

8. In a cylinder-shaped cutting body in accordance with claim 7, wherein the basic part (20) and the chisel holder (30) are forged, hardened and tempered.

9. In a cylinder-shaped cutting body in accordance with claim 1, wherein said chisel receptacle (33) of the chisel holder (30) is offset with respect to the plug-in neck (31) in a direction opposite to the running direction of the cutting body, and an axis (34) of the chisel receptacle (33) is inclined in a direction of the cutting body and forms an acute angle (36) with a diameter (35) of the cutting body at a tip of the chisel (40).

10. In a cylinder-shaped cutting body in accordance with claim 1, wherein behind the chisel receptacle (33) of the chisel holder (30), a top surface of the basic part (20) is recessed in the direction toward the cutting body surface (10).

11. In a cylinder-shaped cutting body in accordance with claim 1, wherein a cross section of the plug-in neck (31) and the plug-in receptacle (21) are rectangular with one of rounded-off and slanted corners, one side of the plug-in neck (31) faces the pressure screw (50), and a front face of the pressure screw (50) is supported on a pressure surface (38) of a recess (37) in said side of the plug-in neck (31).

12. In a cylinder-shaped cutting body in accordance with claim 11, wherein a longitudinal axis of the pressure screw (50) is aligned at an angle of less than 90° with respect to a longitudinal axis of the plug-in neck (31) of the chisel holder (30).

13. In a cylinder-shaped cutting body in accordance with claim 1, wherein the basic part (20) has a lateral recess (25) on an underside facing the cutting body surface (10), said lateral recess (25) extending as far as the plug-in receptacle 21 for the plug-in neck (31) of the chisel holder (30).

14. In a cylinder-shaped cutting body in accordance with claim 1, wherein the basic part (20) and the chisel holder (30) are forged, hardened and tempered.

* * * * *